US005390483A

United States Patent [19]

Koga et al.

[11] Patent Number: 5,390,483

[45] Date of Patent: Feb. 21, 1995

[54] TRAVELER CHANGING METHOD AND TRAVELER CHANGING APPARATUS FOR CARRYING OUT THE SAME

[75] Inventors: Toshiaki Koga; Hiroo Otoshima, both of Shiga; Itaru Yokota, Uji, all of Japan

[73] Assignee: Murata Kikai Kabushiki Kaisha, Kyoto, Japan

[21] Appl. No.: 941,396

[22] Filed: Sep. 8, 1992

[30] Foreign Application Priority Data

Sep. 12, 1991 [JP] Japan ..... 3-262682
Nov. 14, 1991 [JP] Japan ..... 3-326960

[51] Int. Cl.[6] ..... D01H 9/14; B23P 19/04

[52] U.S. Cl. ..... 57/262; 29/765; 57/278; 57/279

[58] Field of Search ..... 57/119, 125, 278, 279, 57/262; 29/765

[56] References Cited

U.S. PATENT DOCUMENTS 3,054,248 9/1962 Austel ..... 29/765 X
3,191,284 6/1965 Eurey ..... 29/765 X
3,540,200 11/1970 Tsukumo et al. ..... 57/262
3,546,870 12/1970 Schewe et al. ..... 57/262
3,591,951 7/1971 Urano et al. ..... 57/262
3,905,187 9/1975 Harmon et al. ..... 57/262
4,373,247 2/1983 Holenstein et al. ..... 29/765 X
4,575,933 3/1986 Neff ..... 29/765
4,645,109 2/1987 Fleissner ..... 226/119 X

FOREIGN PATENT DOCUMENTS 2051754 4/1972 Germany ..... 57/262
3934899 4/1991 Germany ..... 57/262
17121 1/1985 Japan ..... 57/125

*Primary Examiner*—Daniel P. Stodola
*Assistant Examiner*—William Stryjewski
*Attorney, Agent, or Firm*—Spensley Horn Jubas & Lubitz

[57] ABSTRACT

A traveler changing method and an apparatus for carrying out the same capable of automatic traveler changing operation for labor saving. The traveler changing method comprises steps of positioning a traveler at a predetermined position on a ring by turning a bobbin in the normal direction with a roller, drawing portions of a yarn extending through the traveler to the ring, removing the traveler positioned at the predetermined position by a traveler removing device, and putting a new traveler on the ring at a position on the ring where the yarn is contiguous with the ring.

3 Claims, 15 Drawing Sheets

TRAVELER CHANGING METHOD AND TRAVELER CHANGING APPARATUS FOR CARRYING OUT THE SAME

BACKGROUND OF THE INVENTION

1. Field of the Invention

The present invention relates to a traveler changing method for automatically changing a traveler attached to the ring of a ring spinning frame, and a traveller changing apparatus for carrying out the same.

2. Related Art Statement

A ring spinning frame using travelers will be described with reference to FIG. 16. Bobbins 2 are put respectively on spindles 1 supported in bearings, not shown. The spindles 1 are rotated at a high rotating speed in the range of 10,000 to 20,000 rpm by belts 3. Each belt 3 is wound around the four spindles 1, i.e., two spindles 1 on one side of the ring spinning frame and two spindles 1 on the other side of the same, and is driven by a driving pulley, not shown, to rotate the spindles 1. If the spindle 1 is stopped forcibly during operation, the belt 3 slips relative to the spindle 1. A ring rail 4 moves vertically along the axes of the bobbins 2. The bobbins 2 are set upright so as to extend respectively through rings 5 fixed to the ring rail 4. Each ring 5 has a flange 6 at its upper end and a traveler 7 is put on the flange 6. A yarn Y travels via a snail wire 8, a balloon control ring 9 and the traveler 7 and is taken up on the bobbin 2. When the bobbin 2 is rotated, the yarn drags the traveler 7 so that the traveler 7 travels along the flange 6 of the ring 5 to twist the yarn. The difference between the rotating speed of the bobbin 2 and the revolving speed of the traveler 7 corresponds to the length of the yarn delivered. The length of the yarn is taken up on the bobbin 2. The ring 5 and the traveler 7 serve as frictional means for making the revolving speed of the traveler 7 different from the rotating speed of the bobbin 2 and form a traveling direction changing mechanism for converting a twisting action into a winding action.

The traveler 7 is a small, C-shaped metal clip that is put on the flange 6 of the ring 5. Since the traveler 7 revolves along the flange 6 of the ring 5 at a high revolving speed in the range of about 10,000 to about 20,000 rpm, the traveler 7 needs to be changed for a new one every week or every two weeks.

It is usual practice to change the traveler by hand, in which an old traveler is removed from the ring with a suitable tool, and then a new traveler is put on the ring. In some cases, a traveler attaching device for attaching a new traveler to the ring., disclosed in Japanese Patent Publication (Kokoku) No. Sho 61-44975 is used for attaching a new traveler to the ring.

The conventional traveler changing method requires the manipulation of the tool by hand, and hence even a skilled operator needs considerably time for changing all the travelers of a ring spinning frame. Accordingly, much time and labor must be spared to changing the travelers.

OBJECT AND SUMMARY OF THE INVENTION

The present invention has been made in view of the foregoing problems in the prior art and it is therefore an object of the present invention to provide a traveler changing method and apparatus capable of automatically changing travelers to save labor. Since the traveler stops at an indefinite position on the ring with the yarn extending therethrough, the traveler needs to be positioned at a predetermined position and the yarn needs to be extended in a particular state before changing the traveler.

A traveler changing method in accordance with the present invention comprises sequential or simultaneous steps of: placing a traveler at a predetermined position on a ring; drawing the yarn extending through the traveler to the ring; removing the traveler from the ring at the predetermined position; and putting a new traveler on the ring at a position on the ring where the yarn is held on the ring so that the yarn extends through the new traveler.

A traveler changing apparatus of the present invention has a traveler changing unit supported on a carriage that travels along a ring spinning frame and comprises: a positioning means for positioning the traveler changing unit relative to the ring; a means for turning the bobbin set in the ring in the normal or reverse direction; a means for stopping a traveler on the ring at a predetermined position on the ring; a yarn drawing means for drawing the yarn to the ring; a traveler removing means and a traveler attaching means.

Traveler changing operation can be automatically achieved by a series of operations for positioning the traveler at a predetermined position, drawing the yarn to the ring, removing the old traveler from the ring and putting a new traveler on the ring.

Further, a traveler changing apparatus of the present invention comprises: a yarn drawing device, a traveler removing device, a traveler attaching device, and a take-up device for taking up the slack in the yarn to enable the yarn drawing device to function properly.

The yarn needs to be slackened to draw the yarn extending through the traveler to a predetermined position. The tension device takes up the slack in the yarn before traveler changing operation to accumulate the yarn therein and releases the accumulated yarn when the yarn drawing device operates to draw the yarn to the predetermined position.

BRIEF DESCRIPTION OF THE DRAWINGS

FIG. 17 is a side view of a traveler changing unit of a traveler changing apparatus.

DETAILED DESCRIPTION OF PREFERRED EMBODIMENT

Figure 1:
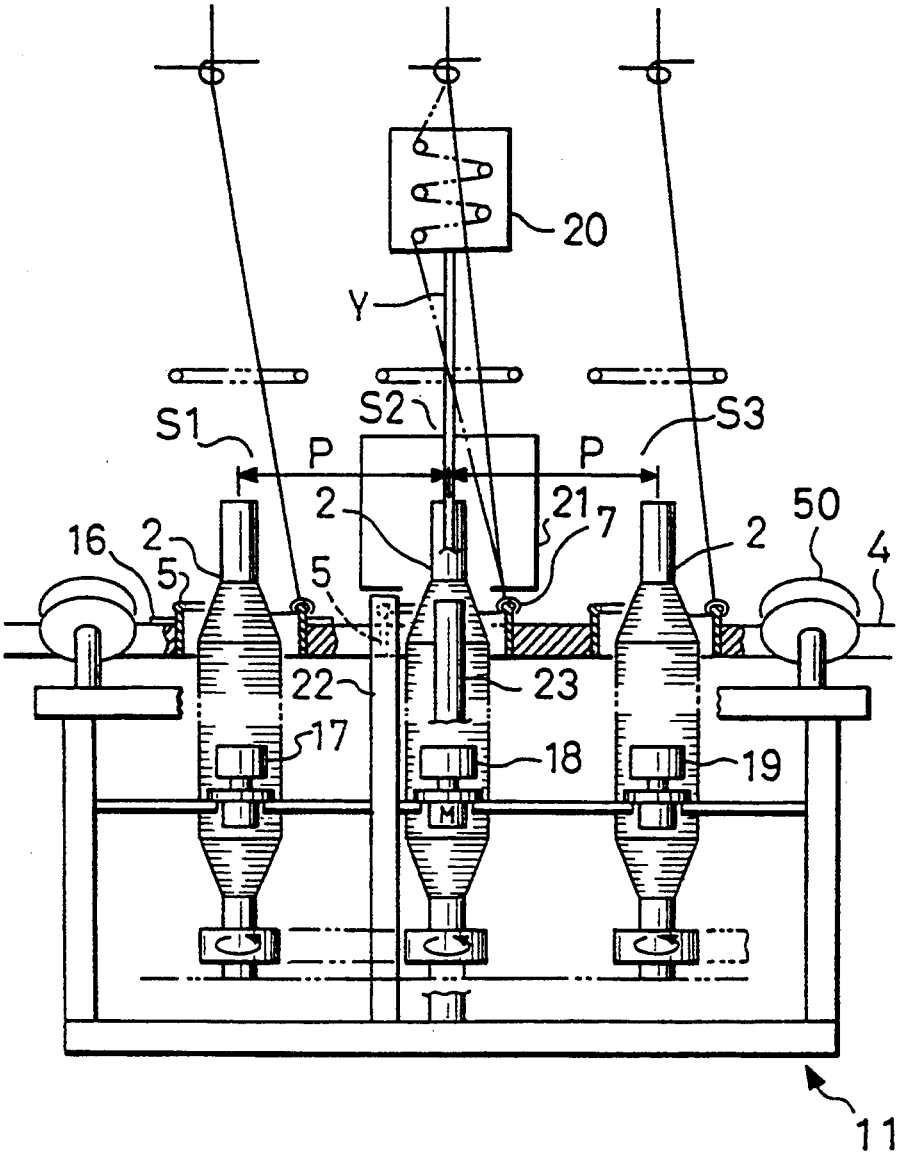
FIG. 1 is a front view of a traveler changing unit included in a traveler changing apparatus.
Figure 2A:
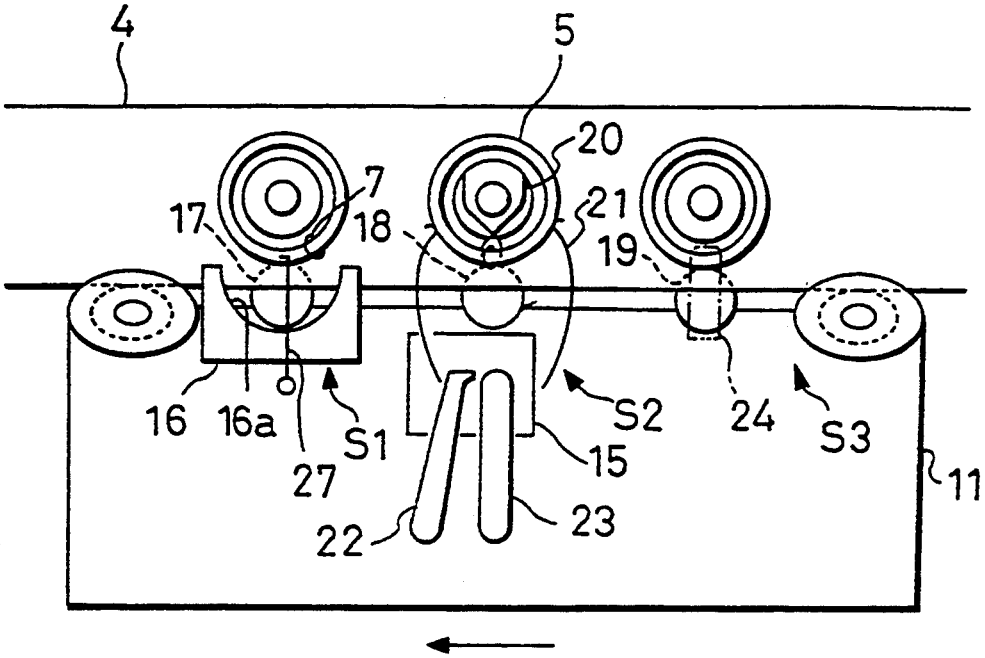
FIGS. 2*a* and 2*b* are a top plan view and a schematic view, respectively, of the traveler changing unit of the traveler changing apparatus.

A preferred embodiment of the present invention will be described hereinafter with reference to the accompanying drawings. FIG. 1 is a front view of a traveler changing unit included in a traveler changing apparatus, FIG. 2 is a top plan view of the traveler changing unit of the traveler changing apparatus and FIGS. 3*a* and 3*b* are a schematic side view and a schematic front view, respectively, of the traveler changing apparatus. The general construction of the traveler changing apparatus will be described with reference to FIGS. 3*a* and 3*b*, and then the individual essential portions of the traveler changing apparatus will be described.

Referring to FIGS. 3*a* and 3*b*, the traveler changing apparatus has a carriage 12, a traveler changing unit 11 supported on the carriage 12, and a wheeled control unit 13 connected to the carriage 12. The carriage 12 comprises a base 43, wheels 41 and 42 attached to the base 43 so as to roll along a guide rail 10 extended along a ring spinning frame SF, a plate spring 44 having one end fixed to the base 43, and a guide rod 45 supported in an upright position on the plate spring 44. The traveler changing unit 11 is supported for vertical movement on the guide rod 45 by means of linear bearings or the like. Guide pulleys 47 are held on the upper end of the guide rod 45. A wire 48 extended around the guide pulleys 47 has one end connected to the traveler changing unit 11 and the other end connected to a counterweight 49 counterbalancing the weight of the traveler changing unit 11. The counterweight 49 may be substituted by a compression coil spring 62 indicated by alternate long and two short dashes lines in FIG. 3*b*.

Figure 4B:
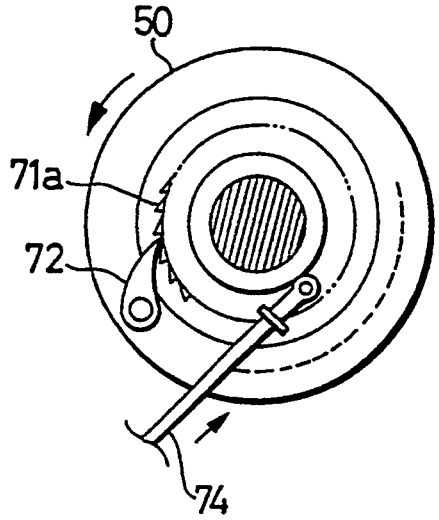
FIGS. 4*a* and 4*b* are a fragmentary top plan view and a fragmentary side view, respectively, of wheels in another embodiment for the traveler changing apparatus.
Figure 4A:
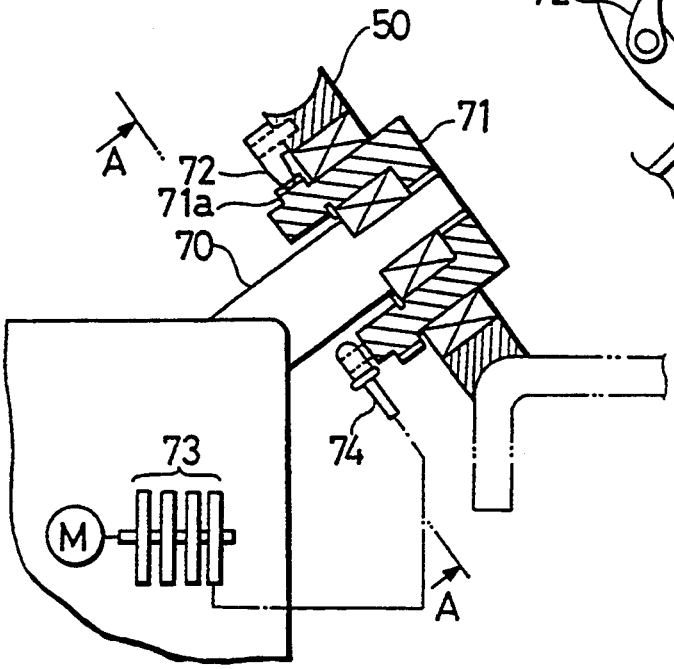

The traveler changing unit 11 is provided with magnet wheels 50 supported with their axes inclined at an angle of 45° so as to roll along the square edge of the ring rail 4 of the ring spinning frame. Magnets are fitted in recesses formed in the circumferences of the magnet wheels 50 to attract the magnet wheels 50 to the edge of the ring rail 4. The magnet wheels 50 are driven for rotation by a motor 51 or a link-and-cam mechanism as shown in FIGS. 4*a* and 4*b*. FIG. 4*a* is a sectional view of the link-and-cam mechanism for driving the magnet wheels 50 and FIG. 4*b* is a sectional view taken on line A—A in FIG. 4*a*. Referring to FIGS. 4*a* and 4*b*, a rotary core 71 is journaled on a fixed shaft 70, and a wheel 50 is supported rotatably on the rotary core 71. A ratchet wheel 71*a* is attached to the rotary core 71, and a pawl 72 engaging the ratchet wheel 71*a* is supported on the wheel 50. A link 74 reciprocated by a cam unit 73 is connected to the outer circumference of the rotary core 71. The cam unit 73 operates the components of a traveler removing device and the associated devices and drives the link 74 for timed reciprocation. When the link 74 is moved in the direction of the arrow, the ratchet wheel 71*a* engaging the pawl 72 turns the wheel 50 in the direction of the arrow to shift the traveler changing unit 11 by a distance corresponding to the pitch P of the rings. A positioning mechanism positions the traveler changing unit relative to the rings.

Figure 5A:
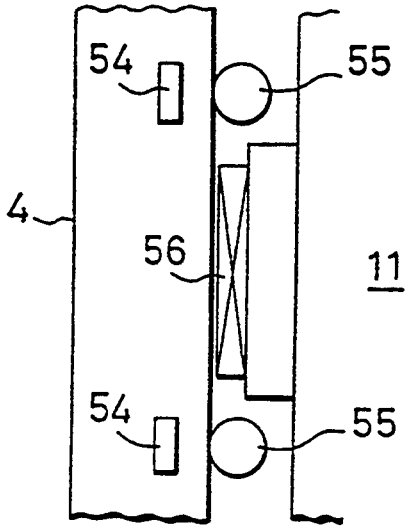
FIGS. 5*a* and 5*b* are plan view and a side view, respectively, of wheels in another embodiment for the traveler changing unit.
Figure 5B:
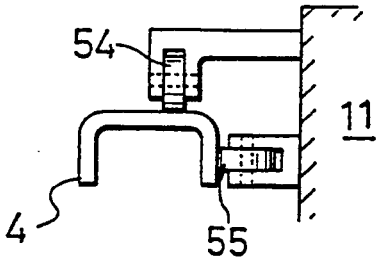

Referring again to FIGS. 3*a* and 3*b*, the wheeled control unit 13 connected to the carriage 12 is provided with wheels 52 that roll on the floor. The wheeled control unit 13 is connected to the base 43 of the carriage 12 by links 53 to travel together with the carriage 12. Since the wheeled control unit 13 is loaded with a lead battery and the weight of the same is about two to three times that of the traveler changing unit 11, the wheeled control unit 13 is supported on the floor for running. FIGS. 5*a* and 5*b* are a top plan view and a side view, respectively of a modification of the traveler changing unit 11. A traveler changing unit 11 shown in FIGS. 5*a* and 5*b* employ a magnet, instead of the magnet wheels 50, and are provided with vertical wheels 54 and horizontal wheels 55. The vertical wheels 54 is supported with their axes in a horizontal position so as to roll along the upper surface of the ring rail 4, and the horizontal wheels 55 are supported with their axes in a vertical position so as to roll along the front side surface of the ring rail 4. A magnet 56 is attached to a suitable portion of the wheeled traveler changing unit 11 with a minimum possible gap formed between the ring rail 4 and the magnet 56 so that a high magnetic attraction works between the ring rail 4 and the traveler changing unit 11.

Referring to FIGS. 3*a* and 3*b*, the traveler changing apparatus is moved by hand after turning the links 53 upward and fastening the base 43 to the wheeled control unit 13 to a ring spinning frame SF requiring traveler changing operation. Then, the links 53 are turned downward to set the wheels 41 in rolling contact with the front side surface of the guide rail 10 and to set the wheels 42 in rolling contact with the upper surface of the guide rail 10. The ring rail 4 reciprocates vertically in a range corresponding to a stroke L while the ring spinning frame is in operation and stops at an indefinite height in the stroke L when the ring spinning frame is brought to a stop. The height of the traveler changing unit 11 is adjusted so that the magnetic wheels 50 engage the upper front edge of the ring rail 4 firmly by magnetic attraction. The counterweight 49 facilitates the adjustment of the height of the traveler changing unit 11 and avoids loading the ring rail 4 excessively. It is preferable that the counterweight 49 has a weight slightly smaller than that of the traveler changing unit 11 so that the ring rail 4 is loaded to some extent. This is because the ring rail 4 comes off lifter rods when upward external force is applied thereto. The traveler changing unit 11 can be easily made to engage the ring rail 4 simply by placing the same at a predetermined position relative to the ring rail 4, because the magnetic wheels 50 (FIGS. 3*a* and 3*b*) or the magnet 56 (FIGS. 5*a* and 5*b*) hold the traveler changing unit 11 on the ring rail 4 by magnetic attraction. Since the wheeled control unit 13, which is the heaviest unit, is separated from the traveler changing unit 11, the traveler changing unit 11 can be easily mounted on and removed from the ring rail 4.

Each magnetic wheel 50 is driven by the motor 51 (FIGS. 3*a* and 3*b*) or by the link 74 (FIGS. 4*a* and 4*b*) for rotation through a predetermined angle at a time to shift the traveler changing apparatus by a distance corresponding to the pitch P of the rings 5 on the ring rail, 4 at a time. Since the traveler changing unit 11 is connected through the plate spring 44, the base 43 and the links 53 to the wheeled control unit 13, the wheeled control unit 13 moves together with the traveler changing unit 11. Since the traveler changing unit 11 is supported on the plate spring 44, the traveler changing unit 11 can be moved slightly, relative to the base 43, by a small force for positional adjustment, relative to the ring 5. The traveler changing unit 11 can be quickly positioned by a positioning mechanism, which will be described later. The wheeled control unit 13 may be provided with a motor for driving the wheels 52 and the plate spring 44 may be provided with a stress sensor 44*a* to detect stress induced in the plate spring 44 to make the motor drive the wheels 52 when the stress induced in the plate spring 44 exceeds a predetermined limit.

Figure 6A:
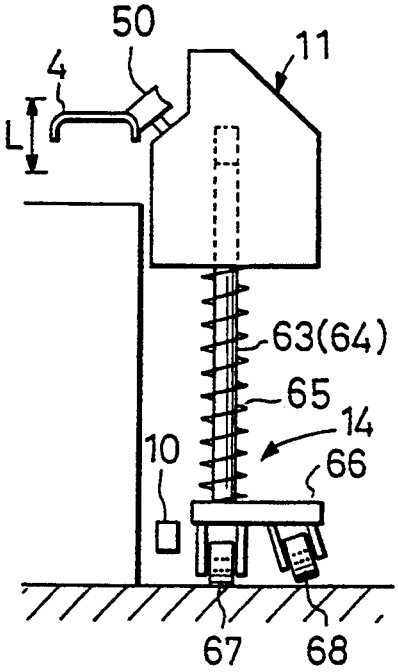
FIGS. 6*a* and 6*b* are a side view and a front view, respectively, of a carriage in another embodiment for the traveler changing apparatus.
Figure 6B:
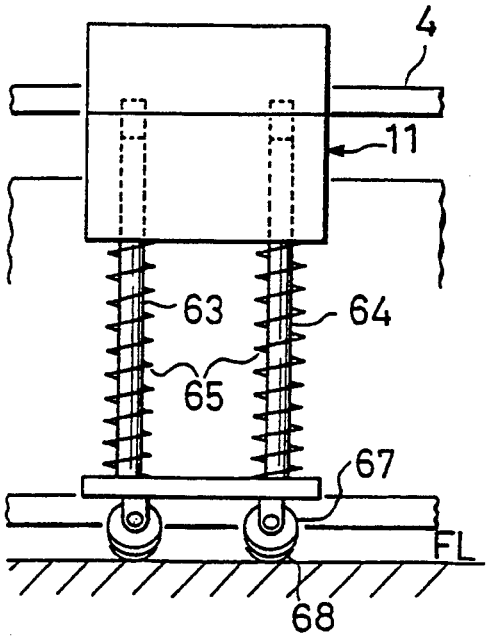

FIG. 6*a* and 6*b* are a side view and a front view, respectively, of a carriage in another embodiment. A traveler changing unit 11 shown in FIGS. 6*a* and 6*b* includes a control unit corresponding to the wheeled control unit 13 of FIGS. 3*a* and 3*b*. The traveler changing unit 11 is supported on two posts 63 and 64 by compression springs 65 for vertical sliding movement along the posts 63 and 64 to enable the adjustment of the height of the traveler changing unit 11 relative to the ring rail 4, which stops at an indefinite position in the stroke L of the ring rail 4. The compression springs 65 must be capable of avoiding the excessive loading of the ring rail 4. The posts 63 and 64 are set upright on a base 66 provided with wheels 67 and 68. The wheels 67 are attached to the base 66 at positions directly below the posts 63 and 64, respectively, so as to move together with magnetic wheels 50 along the ring spinning frame. The wheels 68 are tilted outward so as to stand vertically when the traveler changing unit 11 is tilted for transportation. The wheels 67 may roll along a guide rail 10 extended along the ring spinning frame instead of rolling on the floor FL. However, a complicated procedure is needed in moving the traveler changing apparatus from one ring spinning frame to another if the wheels 67 are arranged so as to roll along the guide rail 10. If the wheels 67 are arranged so as to roll along the floor FL, irregularities in the surface of the floor FL will limit the moving speed of the traveler changing apparatus. The traveler changing apparatus shown in FIGS. 3*a* and 3*b* having the traveler changing unit 11 and the separate wheeled control unit 13 connected by the links 53 to the carriage 12 can be easily and smoothly moved from one ring spinning frame to another.

Referring to FIGS. 1 and 2, the traveler changing unit 11 shown in FIGS. 3*a* and 3*b* or in FIGS. 6*a* and 6*b* is provided with a positioning plate 16, three rollers 17, 18 and 19 capable of being brought into contact with and separated from three bobbins, respectively, a tension device 20, a yarn drawing device 21, a traveler removing device 22, a traveler attaching device 23, a yarn slack take off device 24 and a waste traveler box 15. These components of the traveler changing unit 11 other than the rollers 17, 18 and 19, i.e., the positioning plate 16, the tension device 20, the yarn drawing device 21, the traveler removing unit, the traveler attaching device 23 and the yarn slack take off device 24, are operated by cams mounted on a camshaft.

Figure 2B:
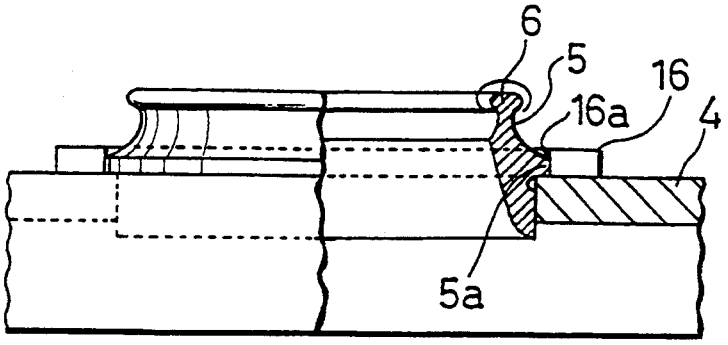
Figure 3B:
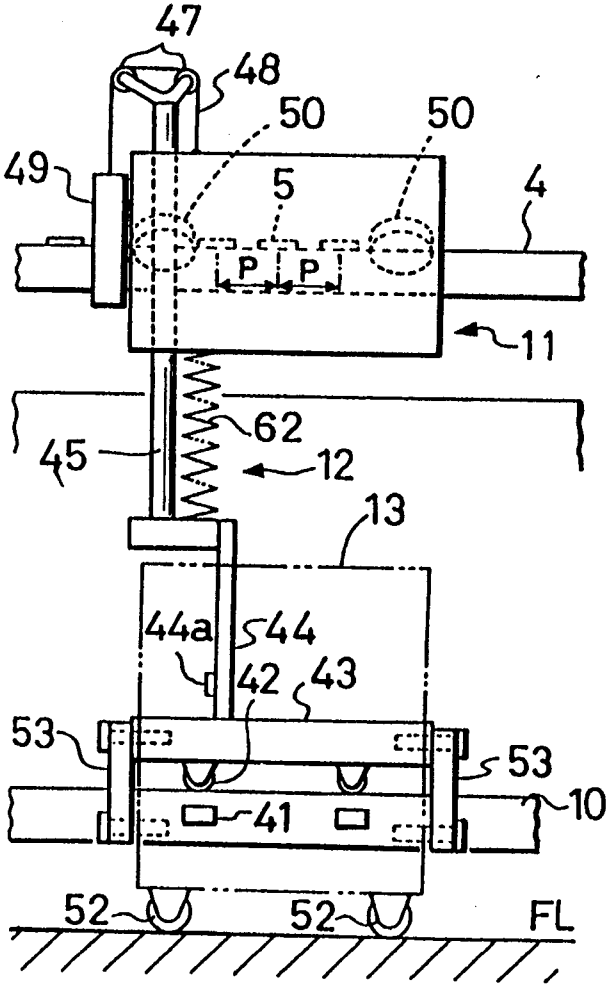
FIGS. 3*a* and 3*b* are a side view and a front view, respectively, of the traveler changing apparatus.
Figure 3A:
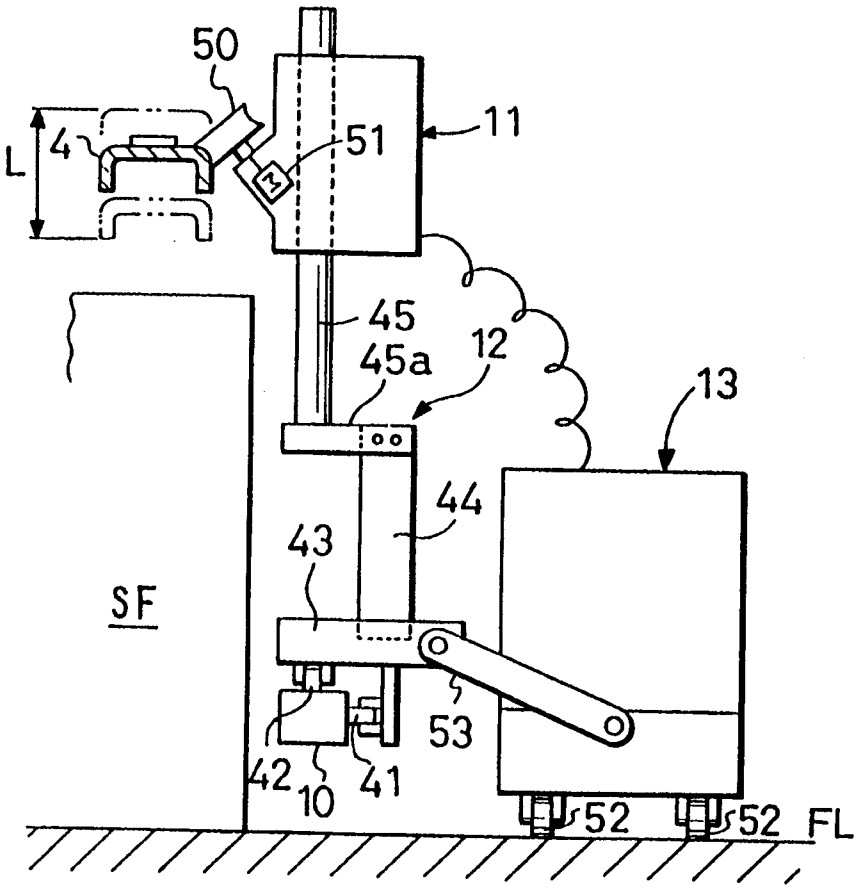
Figure 7A:
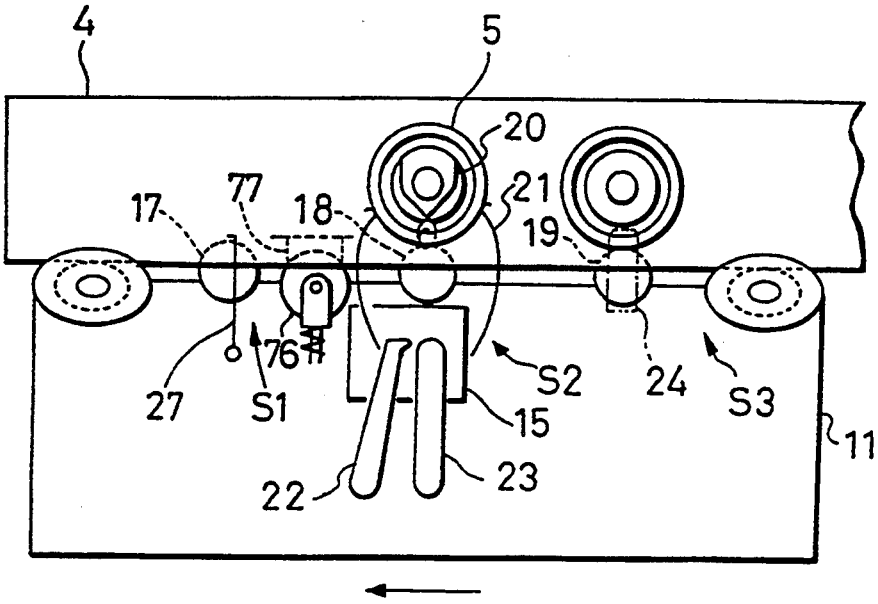
FIGS. 7*a* and 7*b* are a plan view and a side view, respectively, of a positioning mechanism in another embodiment.
Figure 7B:
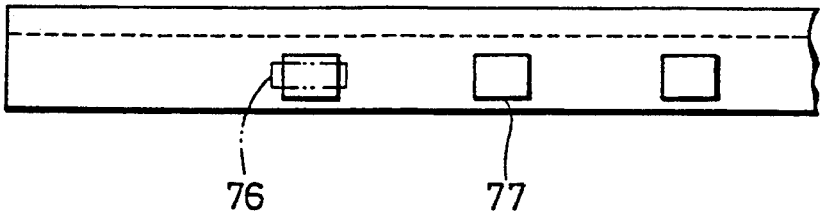

As shown in FIG. 2*b*, each of the rings 5 has a flange 6 along which a traveler slides and a setting flange 5*a* to be seated on the ring rail 4. As shown in FIG. 2*a*, the positioning plate 16 of the positioning mechanism has a semicircular edge 16*a* fitting the circumference of the setting flange 5*a* of the ring 5. The positioning plate 16 is advanced toward the ring 5 to position the components of the traveler changing unit 11. When the positioning plate 16 is provided in the preparation station S1, the positioning plate 16 is ineffective in changing the traveler of the ring at the extremity of the ring rail 4. Therefore, it is preferable to provide the traveler changing apparatus additionally with another positioning means for positioning the traveler changing unit 11 for traveler changing operation for the ring at the extremity of the ring rail 4. The positioning plate 16 may be provided in a traveler changing station S2. Although the traveler changing unit 11 can be positioned by the positioning plate 16 for the ring at the extremity of the ring rail 4 if the positioning plate 16 is provided in the traveler changing station S2, it is necessary to contrive to arrange the components including the waste traveler box 15 in designing the traveler changing unit 11. FIGS. 7*a* and 7*b* are a plan view and a side view, respectively, of another positioning mechanism. The positioning mechanism has a roller 76 supported on the traveler changing unit 11 and urged toward the ring rail 4. Rectangular recesses 77 are formed in the side surface of the ring rail 4 respectively at positions corresponding to the rings 5. As the traveler changing unit 11 is moved along the ring rail 4, the roller 76 drops into the rectangular recess 77 to position the traveler changing unit 11. Although this positioning mechanism is capable of positioning the traveler changing unit 11 for the ring at the extremity of the ring rail 4, the ring rail 4 must be provided beforehand with the rectangular recesses 77. The traveler changing apparatus may be provided, instead of the positioning mechanism employing the positioning plate 16, with any suitable positioning mechanism. The traveler changing unit 11 may be provided with a positioning mechanism provided with a sensor capable of measuring the distance traveled by the traveler changing unit 11 from a reference point.

Referring again to FIGS. 2*a* and 2*b*, the rollers 17, 18 and 19 are capable of being brought into contact with the circumferences of three bobbins 2, respectively, and of being individually driven for rotation respectively by individual motors. Suppose that the traveler changing unit 11 moves from right to left, as viewed in FIG. 2*a*, to change the travelers of the rings 5 sequentially. The roller 17 turns the bobbin 2 in the reverse direction to slacken the yarn, the roller 18 turns the bobbin 2 in the normal direction to take up the yarn accumulated in the take-up device 20 and to move the traveler 7 to a predetermined position, which is determined by the traveler removing device, and the roller 19 turns the bobbin 2 in the normal direction to tighten the yarn.

Figure 8A:
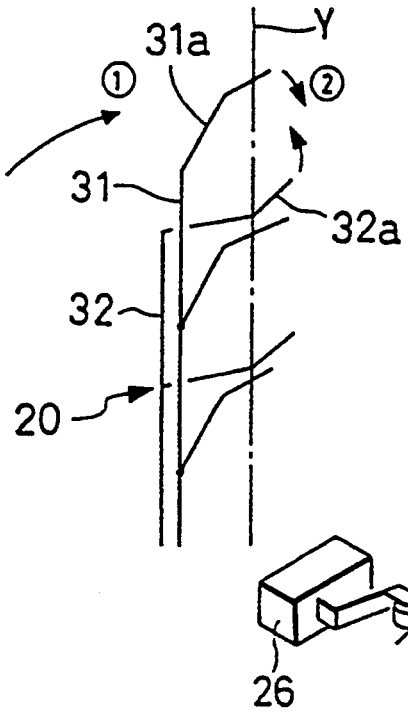
FIGS. 8*a* and 8*b* are perspective views of assistance in explaining the structure and functions of a tension device.
Figure 8B:
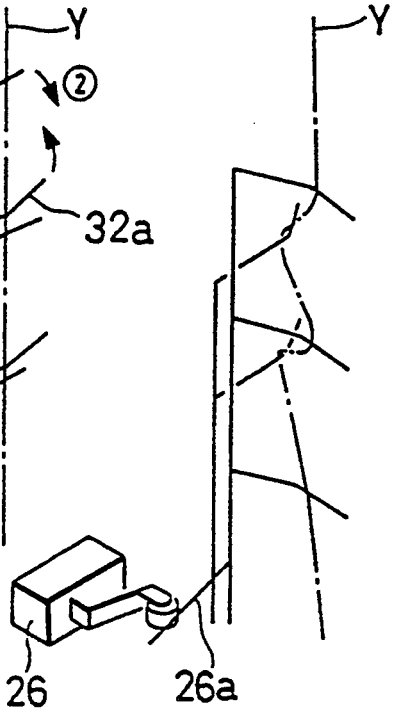

As shown in FIGS. 8*a* and 8*b*, the take-up device 20 comprises a pair of combs 31 and 32 disposed with their teeth in alternate arrangement. The comb 31 has three teeth 31*a*, and the comb 32 has two teeth 32*a*. The take-up device 20 is advanced in the direction of the arrow (1) to receive the yarn Y between the teeth 31*a* and 32*a*. Then, the teeth 31*a* and 32*a* are turned toward the yarn Y in the directions of the arrows as shown in FIG. 8*b*, so that the yarn Y is extended zigzag between the teeth 31*a* and 32*a* to tighten the slack in the yarn Y. The tension device 20 is capable of perfectly taking up the slack in the yarn Y produced by the roller 17 and of tightening the yarn Y in a tension which will not break the yarn Y. Consequently, the yarn drawing device 21 is able to surely catch the yarn Y and to draw the yarn accumulated in the tension unit 20. An actuator 26*a* attached to the base end of the tension unit 20 actuates a limit switch 26 to detect the tension of the yarn Y. If the length of the slack in the yarn Y is insufficient (in this state, the yarn drawing device 21 is unable to function properly), the limit switch 26 is not closed. In such a case, the bobbin 2 is turned further in the reverse direction by a roller, not shown, until the limit switch 26 is closed. When the bobbin 2 is turned in the normal direction to move the traveler to the predetermined position, the limit switch 26 is opened to indicate that the subsequent operation is possible. Although the tension device 20 is of a gate tenser type having the pair of combs 31 and 32 in this embodiment, a tension device of a suction type may be used. However, a tension device of a suction type which needs an airsource, is capable of tightening the yarn to a sufficiently high tension and is unsuitable for use in combination with the limit switch 26 for yarn tension detection. Thus, a tension device of a gate tension type is preferable.

Figure 9A:
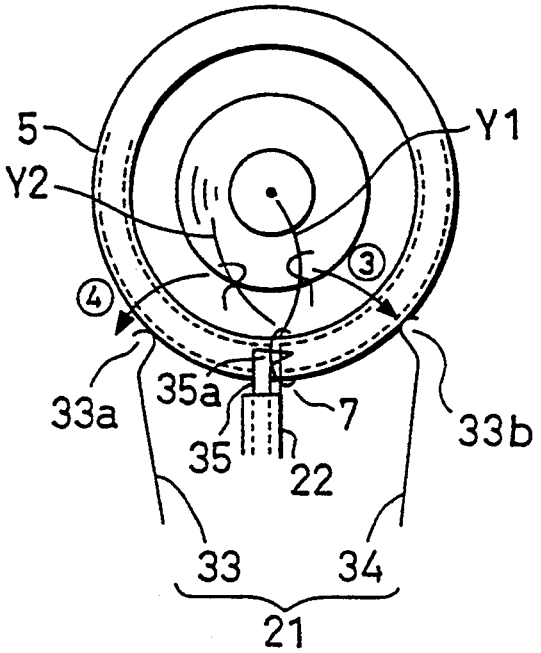
FIGS. 9*a* and 9*b* are a top plan view and a fragmentary sectional view, respectively, of assistance in explaining the structure and functions of a yarn drawing device.
Figure 9B:
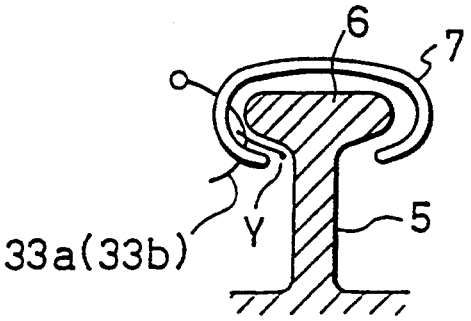

The functions of the yarn drawing device 21 will be described with reference to FIGS. 9*a* and 9*b*. As shown in FIG. 9*a*, the yarn drawing device 21 comprises a pair of levers 33 and 34 having hooks 33*a* and 34*a* at their free ends, respectively. The lever 34 catches an upper portion Y1 of the yarn Y extending above the traveller 7 with its hook 33*b* and moves downward in the direction of the arrow (3) while the hook 33*a* of the lever 33 is moved downward to catch a lower portion Y2 of the yarn Y extending under the traveler 7 with its hook 33*a*, the hook 33*a* is moved upward and so as to ride over the ring 5 in the direction of the arrow (4). Then, as shown in FIG. 9*b*, the yarn Y is extended along the side wall of the ring 5 under the flange 6. The yarn Y need not necessarily be removed from the traveler 7. Prior to the actuation of the yarn drawing device 21, the traveler removing device 22 is positioned and a traveler removing rod 35 stops the traveler 7 moved by the yarn Y as the bobbin 2 is turned in the normal direction at a predetermined position, and then the yarn drawing device 21 is moved near to the flange 6 of the ring 5 so that the operation of the traveler removing device 22 will not be obstructed by the yarn drawing device 21.

Figure 10A:
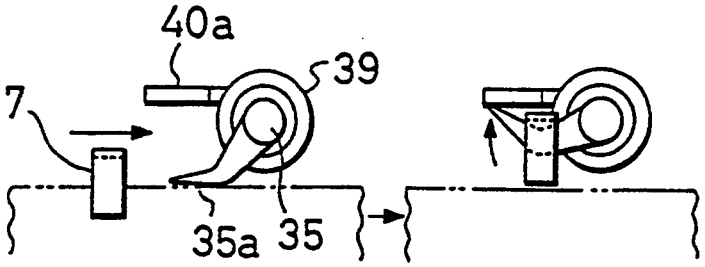
FIGS. 10*a*, 10*b*, 10*c* and 10*d* are views of assistance in explaining the structure and functions of a traveler removing device.
Figure 10B:
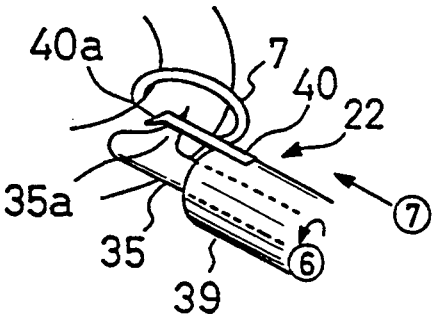
Figure 10C:
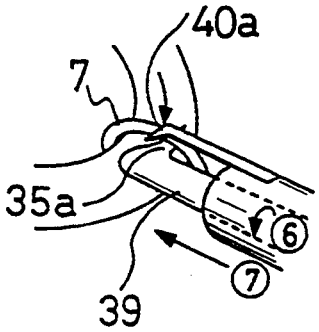
Figure 10D:
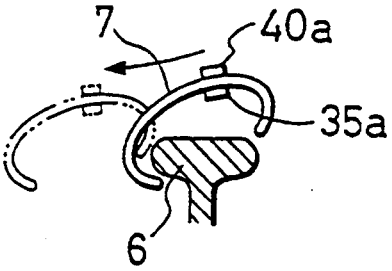

FIGS. 10*a* to 10*d* are views of assistance in explaining the construction and functions of the traveler removing device 22. Referring to FIGS. 10*a* and 10*b*, the traveler removing rod 35 of the traveler removing device 22 has a hook 35*a* at its free end and is supported for turning in the direction of the arrow (6) in a tube 39. A holding plate 40 is attached to the tube 39 so that the traveler 7 is held between the tip 40*a* of the holding plate 40 and the hook 35*a* of the traveler removing rod 35 when the traveler removing rod 35 is turned in the direction of the arrow (6). The tube 39 can be advanced in the direction of the arrow (7). When the roller 18 (FIG. 2) is turned in the normal direction to take up the yarn Y, the traveler 7 is moved into a gap between the hook 35*a* and the holding plate 40 and is stopped by the traveler removing rod 35 as shown in FIG. 10*b*. Then, the traveler removing rod 35 is turned in the direction of the arrow (6) to hold the traveler 7 between the hook 35*a* and the holding plate 40 as shown in FIG. 10*c*, and then the tube 39 is advanced in the direction of the arrow (7) to remove the traveler 7 from the flange 6 of the ring 5 as shown in FIG. 10*d*. If the traveler 7 is at a position where the traveler 7 interferes with the traveler removing device 22 advanced to the predetermined position, it is impossible to remove the traveler 7 successfully. Accordingly, as shown in FIG. 2*a*, the traveler 7 is moved away with an elastic lever 27 from such a position to a position where the traveler 7 will not interfere with the traveler removing device 22. In some cases, the traveler attaching device 23 approaches the flange 6 of the ring 5 first. In such a case, the lever 27 moves the traveler 7 away from a position corresponding to the traveler attaching device 23.

Figure 11A:
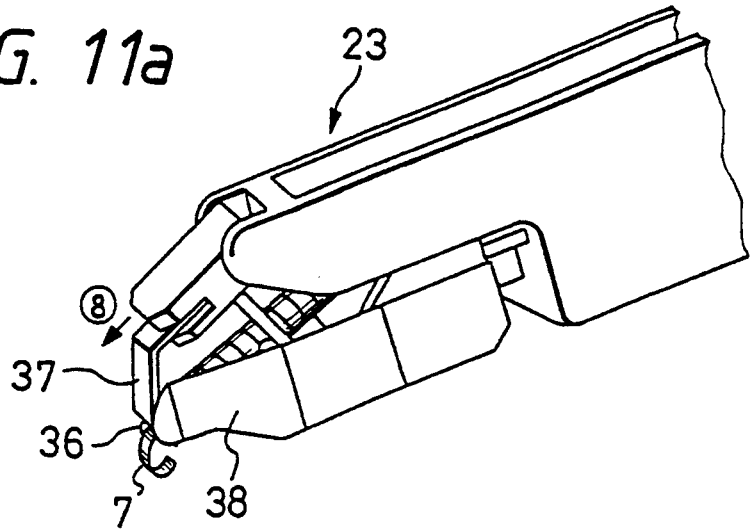
FIGS. 11*a* and 11*b* are views of assistance in explaining the structure and functions of a traveler attaching device.
Figure 11B:
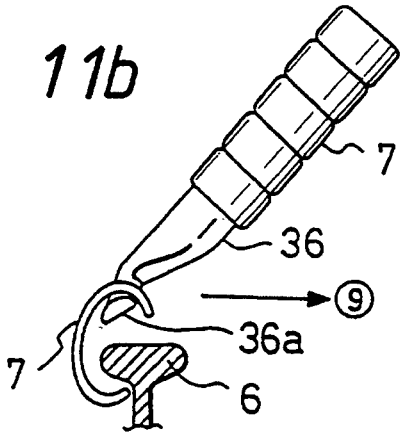

FIGS. 11*a* and 11*b* are views of assistance in explaining the construction and functions of the traveler attaching device 23. As shown in FIG. 11*a*, the traveler attaching device 23 comprises a traveler feed rod 36 having a hook 36*a* (FIG. 9*b*) at its free end, holding a plurality of travelers 7 thereon, a traveler dispensing plate 37 and a plate spring 38. The traveler dispensing plate 37 is moved in the direction of the arrow (8) to move one of the travelers 7 to the hook 36*a* of the traveler feed rod 36 so that the traveler 7 is suspended from the hook 36*a* as shown in FIG. 9*b*. Then, the traveler attaching device 23 is retracted in the direction of the arrow (9) to put the traveler 7 on the flange 6 of the ring 5. At the same time, the plate spring 38 fillips the traveler 7, put on the flange 6 into a rectangular direction to the paper.

Figure 12:
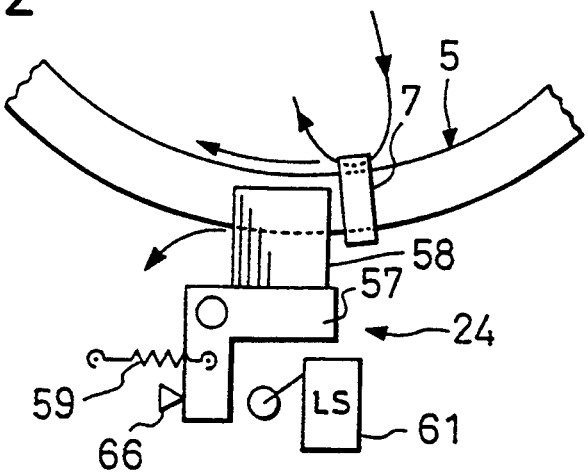
FIG. 12 is a plan view of assistance in explaining the structure and functions of a yarn tension detecting device.

Referring to FIG. 12, the yarn slack take off device 24 comprises a L-shaped lever 571, a brush 58 attached to one of the arms of the L-shaped lever 57, a tension spring 59 biasing the L-shaped lever 57 clockwise, as viewed in FIG. 12, a stopper 66 in contact with the other arm of the L-shaped lever 57 to hold the L-shaped lever 57 in a position shown in FIG. 12, and a limit switch 61 to be operated by the other arm of the L-shaped lever 57. When the bobbin 2 is turned in the normal direction by the roller 19 (FIG. 1) to take up the slack in the yarn Y, the traveler 7 is dragged along the flange 6 of the ring 5 by the yarn Y in the direction of the arrow shown in FIG. 12. Then, the traveler 7 penetrates the brush 58, and the lever 57 is turned counterclockwise by the traveler 7 to actuate the limit switch 61. When a signal, indicating that the yarn Y is tightened, is thus provided, the roller 19 is stopped. If the yarn Y is not tightened after changing the traveler 7 for a new one, the yarn Y will be broken when the ring spinning frame is restarted.

Steps of a traveler changing method to be executed by the traveler changing apparatus will be described hereinafter. Referring to FIG. 1, the traveler changing unit 11 has three working stations, i.e., a preparation station S1, a traveler changing station S2 and a yarn tightening station S3. A yarn slackening operation at the preparation station S1, a traveler changing operation at the traveler changing station S2 and a yarn tightening operation at the yarn tightening station S3 are executed simultaneously to complete the traveler changing cycle in a shortest possible time. In the preparation station S1, the roller 17 is aligned with the middle bobbin among three successive bobbins 2 to turn the middle bobbin in the reverse direction to slacken the yarn. Then, the traveler changing unit 11 is shifted to the left, as viewed in FIG. 1, by a distance equal to the pitch P of the rings 5 to position the traveler changing unit 11 in a state shown in FIG. 1, in which the station S2 is positioned in front of the middle bobbin 2. Then, the positioning plate 16 is advanced and engages the ring 5. Since the traveler changing unit 11 is supported on the plate spring 44, the traveler changing unit 11 can be easily positioned with respect to the rings 5 when the positioning plate 16 engages the ring 5. Then, the take-up device 20 is actuated to accumulate the yarn Y in a zigzag state so that the yarn Y can be pulled out from the take-up device 20 when a predetermined tension is applied to the yarn Y. Then, as shown in FIG. 9*a*, the traveler removing rod 35 of the traveler removing device 22 is advanced toward the ring 5 so that the hook 35*a* thereof is positioned at a predetermined position on the flange 6 of the ring 5. Then, the bobbin 2 is rotated by the roller 18 (FIG. 1) in the normal direction to wind the slack accumulated in the take-up device 20 and, consequently, the traveler 7 turns clockwise along the flange 6 of the ring 5 until the same is caught by the hook 35*a* of the traveler removing rod 35 (FIG. 9*a*). The rotation of the roller 18 is controlled by the control unit so that the roller 18 is rotated by a predetermined number of turns. Then, the levers 33 and 34 of the yarn drawing device 21 are moved in the directions of the arrows ③ and ④, respectively, to pull out the yarn Y further from the take-up device 20 and to hold the yarn Y on the circumference of the side wall of the ring 5 under the flange 6 as shown in FIG. 9*b* so that the yarn y will not interfere with the traveler 7 in removing the traveler 7 from the flange 6.

Then, as shown in FIG. 10*b*, the traveler removing rod 35 is turned in the direction of the arrow ⑥ to hold the traveler between the hook 35*a* and the tip 40*a* of the holding plate 40, and then the traveler removing rod 35 is advanced in the direction of the arrow ⑦ (FIG. 10*c*) to remove the traveler 7 from the flange 6. When the traveler removing device 22 is retracted, the traveler 7 removed from the flange 6 is transported to a position above the waste traveler box 15 (FIG. 2*a*), the hook 35*a* is separated from the tip 40*a* of the holding plate 40 to drop the removed traveler 7 into the waste traveler box 15. Then, as shown in FIG. 11*a*, a new traveler 7 suspended from the traveler feed rod 36 is positioned at a predetermined position over the flange 6 of the ring 5, and then, the traveler feed rod 36 is retracted in the direction of the arrow ⑨. Since one end of the new traveler 7 is in engagement with the flange 6, the new traveler 7 is expanded and the new traveler 7 is put on the flange 6. Then, the plate spring 38 fillips the new traveler 7 into a rectangular direction to the paper on the flange 6.

Figure 13A:
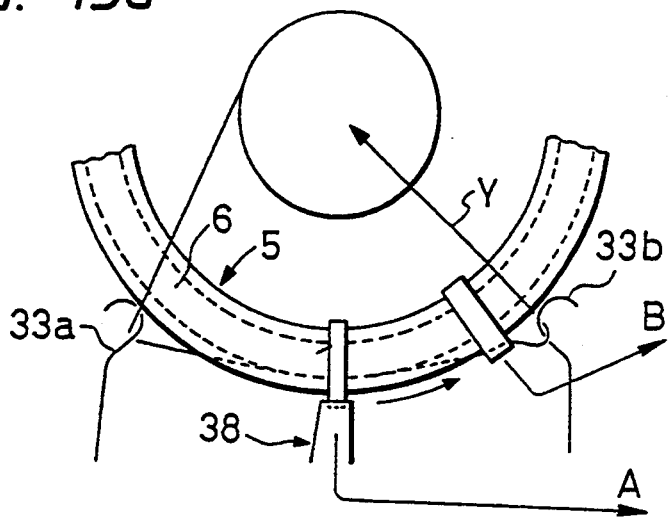
FIGS. 13*a*, 13*b* and 13*c* are views of assistance in explaining steps of a procedure of threading the yarn through the traveler.
Figure 13A:
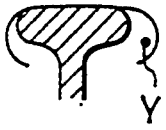
Figure 13A:
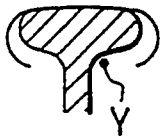
Figure 13B:
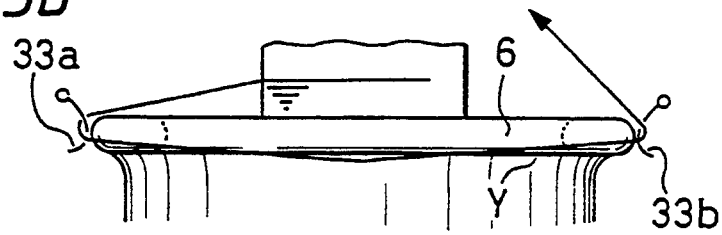
Figure 13C:
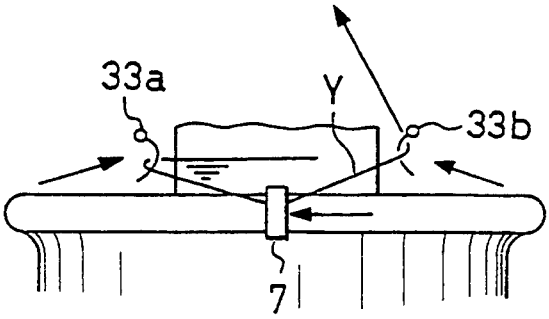

Steps of passing the yarn y through the traveler 7 will be described hereinafter with reference to FIGS. 13*a*, 13*b* and 13*c*. Referring to FIG. 13*a*, the yarn Y caught in the respective hooks 33*a* and 33*b* of the levers 33 and 34 is in contact with the lower circular edge of the flange 6 at a position A and is separated from the flange 6 at a position B. Thus the yarn Y between A and B is tangent to the lower circular edge of the flange 6. As shown in FIG. 13*b*, the yarn Y extends obliquely upward from the hooks 33*a* and 33*b*. In this state, the traveler 7 is put on the flange 6 at the position A. Upon the separation of the traveler 7 from the hook 36*a* of the traveler feed rod 36, the plate spring 38 fillips the traveler 7 along the flange 6. Then, the traveler 7 engages the yarn Y and stops at the position B. In this state, the yarn Y is securely caught by the traveler 7. That is, the yarn Y is not necessarily caught in the traveler 7 if the yarn Y is raised with the traveler 7 at the position A. When the hooks 33*a* and 33*b* is raised obliquely upward to their original positions with the traveler 7 engaging the yarn Y at the position B as shown in FIG. 13*c*, the yarn Y is pulled toward the central portion of the ring 5, being pulled into the traveler 7. Thus, the yarn Y can be surely threaded through the traveler 7.

Figure 14A:
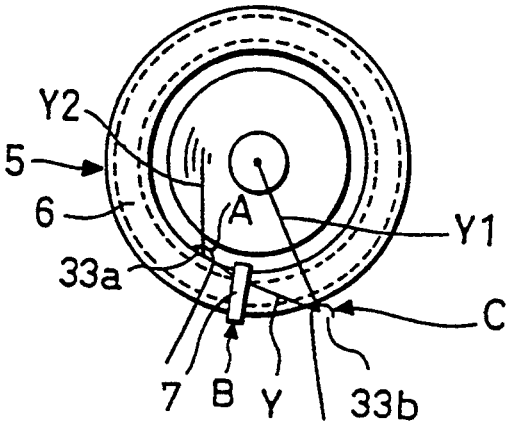
FIGS. 14*a*, 14*b*, 14*c* and 14*d* are views of assistance in explaining steps of another procedure of threading the yarn through the traveler.
Figure 14B:
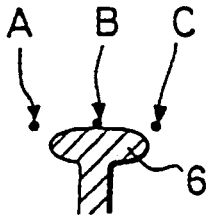
Figure 14C:
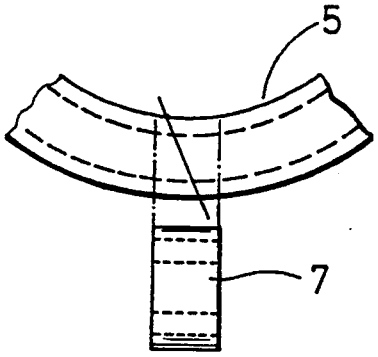
Figure 14D:
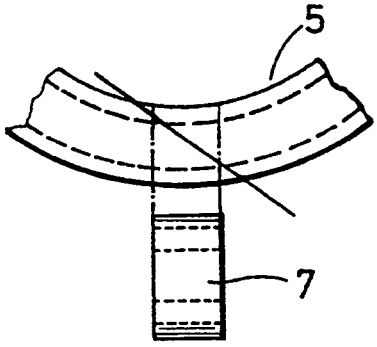

FIGS. 14*a* to 14*d* are views of assistance in explaining a yarn drawing method which enables the omission of the threading operation described with reference to FIGS. 13*a* to 13*c*. Referring to FIG. 14*a*, a hook 33*a* hooks a lower portion Y2 of a yarn Y extending between a bobbin 2 and a traveler 7 and pulls the lower portion Y2 to the inner circumference of the flange 6 of a ring 5, and a hook 33*b* hooks an upper portion Y1 of the yarn Y and pulls the upper portion Y1 to the outer circumference of the flange 6 so that the yarn Y extends obliquely across the flange 6. FIG. 14*b* shows the respective positions with respect to the flange 6 of a point A where the yarn Y is in contact with the hook 33*a*, a point C where the yarn Y is in contact with the hook 33*b*, and a point B where the yarn Y is in contact with the upper surface of the flange 6. Accordingly, the yarn Y is caught in the traveler 7 when the traveler is put on the flange 6 at a position corresponding to the point B (FIG. 14*a*). Thus, the yarn Y can be threaded through the traveler 7 without requiring filliping the traveler 7, which is necessary in threading the yarn Y through the traveler 7 by the method described with reference to FIGS. 13*a* to 13*c*. In removing the old traveler by the traveler removing device after the new traveler has been put on the ring by the traveler attaching device, the old traveler and the new traveler must be at positions corresponding to a portion of the yarn Y between the points A and C to prevent the old traveler catching the yarn Y. When the point A is substantially on a tangent to the inner circumference of the ring 5, the length of a portion of the yarn Y between the points A and C is a maximum and decreases as the point A goes away from the tangent. For example, if the portion of the yarn Y between the points A and C extends on the flange 6 of the ring 5 in a circumferential range of the flange 6 smaller than the width of the traveler 7 as shown in FIG. 14*c*, it is possible that the traveler attaching operation and the traveler removing operation cannot be successfully achieved. When the portion of the yarn Y between the points A and C extends on the flange 6 of the ring 5 in a circumferential range of the flange 6 greater than the width of the traveler as shown in FIG. 14*d*, the traveler attaching operation and the traveler removing operation can be successfully achieved.

After the traveler 7 has been put on the flange 6 by the traveler attaching device, the yarn drawing device 21 (FIG. 9) is returned to its standby position, the slack in the yarn Y is taken up again by the tension device 20, and then the tension device 20 is released. Subsequently, the released tension device 20 is returned to its standby position, and the traveler changing unit 11 is shifted to the left by a distance corresponding to the pitch of the rings 5 to position the station S3 in front of the middle bobbin 2 with the roller 19 in contact with the middle bobbin 2. Then, the middle bobbin 2 is turned in the normal direction by the roller 19 to tighten the yarn Y. Upon the detection of the properly tightened state of the yarn Y by the yarn slack take off device 24, the roller 19 is stopped. In this state, the slack in the yarn Y is perfectly and properly taken up. Thus, the traveler changing operation, which has been believed to be possible only by hand, can be carried out completely automatically, and the old travelers are collected in the waste traveler box 15. Therefore, the old travelers are not scattered around the ring spinning frame and hence the floor around the ring spinning frame need not be cleaned for scattered old traveler.

Although the traveler changing method has been described as comprising the first step of positioning the traveler at a predetermined position on the flange of the ring, the second step of drawing the yarn, the third step of removing the old traveler from the flange of the ring, the fourth step of putting a new traveler on the flange of the ring and the fifth step of tightening the yarn which are executed sequentially, generally, the second to fourth steps are executed simultaneously. The sequence of the steps may be changed if necessary; for example, the fourth step of putting a new traveler on the flange of the ring may be executed before the third step of removing the old traveler.

In the foregoing traveler changing method embodying the present invention, the bobbin 2 is turned in the reverse direction by the roller (FIG. 1) to slacken the yarn beforehand, the traveler changing device 11 is shifted by a distance corresponding to the pitch P of the rings 5, and then the take-up device 20 is actuated. However, it is possible that the yarn escapes from the traveler when the yarn is slackened and it is possible that the traveler cannot be positioned at the predetermined position in the following step. Therefore, it is preferable to provide another take-up device in connection with the roller 17 to slacken a portion of the yarn extending before the ring. If the length of the traveler changing cycle time is not a significant problem, all the steps of traveler changing procedure may be completed at a single station by turning the bobbin in opposite directions by a roller instead of completing the steps of traveler changing procedure at different stations S1, S2 and S3 to reduce the traveler changing cycle time. If all the steps are completed at a single station, the traveler changing unit 11 can be formed in a narrower width, the traveler changing unit 11 may be positioned relative to a single ring to complete all the steps of traveler changing procedure without shifting the traveler changing unit 11. Thus, the old travelers on all the rings including the ring at the extremity of the ring rail of the ring spinning frame can be changed by the same traveler changing operation.

Figure 15:
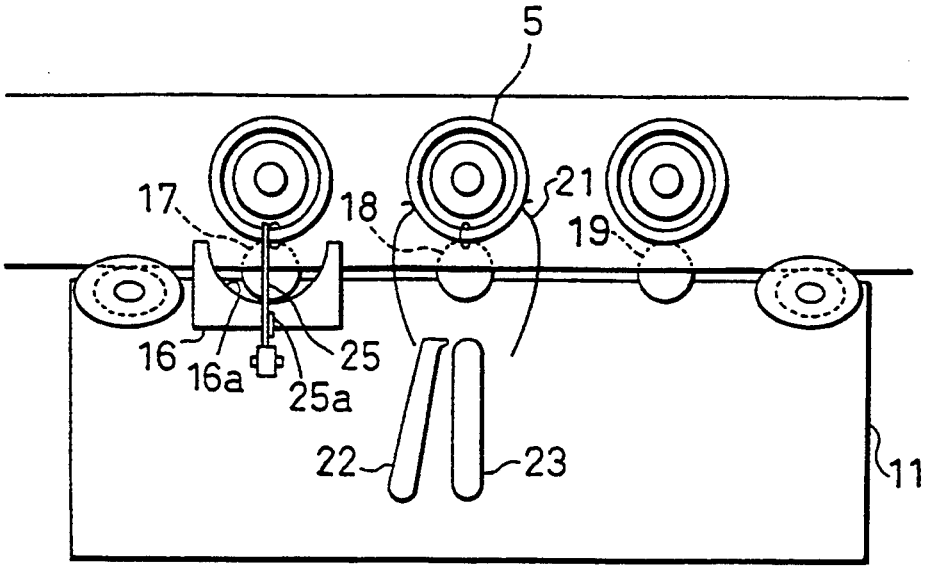
FIG. 15 is a top plan view of a traveler changing apparatus in another embodiment according to the present invention.
Figure 16:
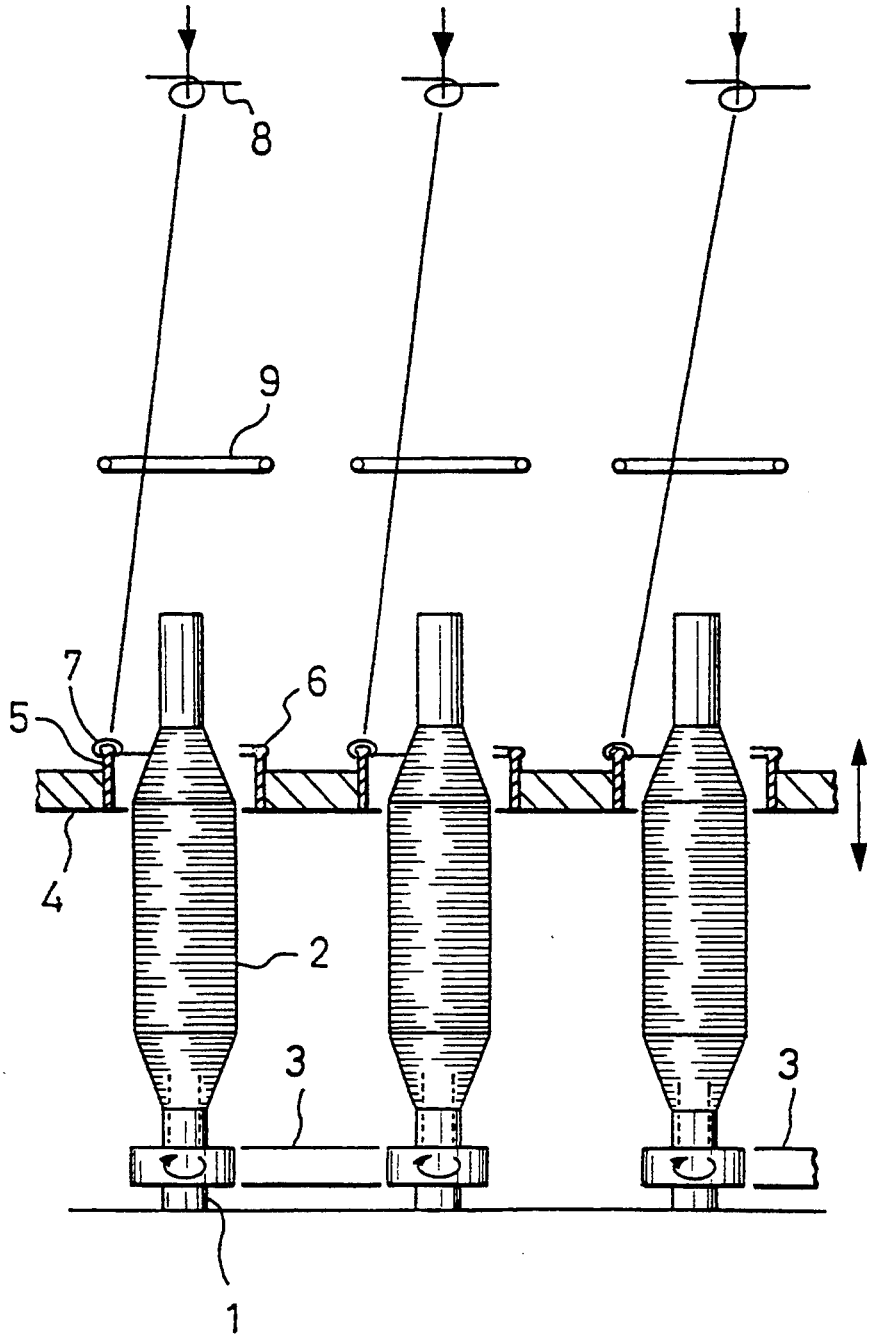
FIG. 16 is a fragmentary front view of a ring spinning frame.
Figure 16:
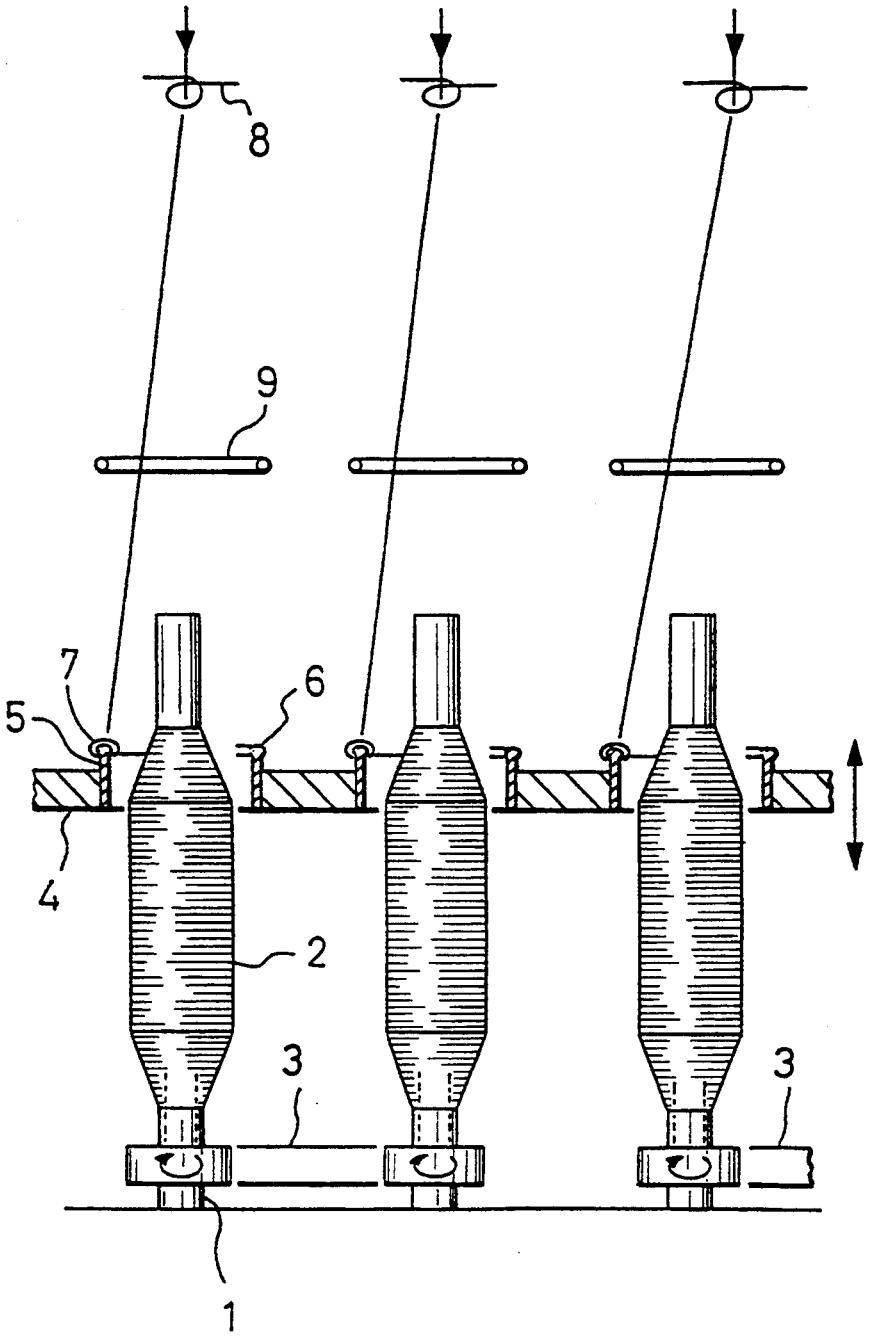

A traveler changing apparatus in another embodiment according to the present invention will be described hereinafter with reference to FIG. 15. The traveler changing apparatus shown in FIG. 15 is different in construction from that shown in FIGS. 2*a* and 2*b* only in that a traveler changing unit 11 of the former is provided with a stopper 25 instead of the tension device. The stopper 25 is a swingable member and provided with a sensor 25*a* and disposed at a position corresponding to a roller 17. Upon the detection of colision of a traveler 7 against the extremity of the stopper 25 by the sensor 25*a*, the roller 17 is stopped to position the traveler 7 at a predetermined position. After the roller 17 has been stopped, the stopper 25 is retracted to its standby position, the traveler changing unit 11 is shifted to the left, as viewed in FIG. 15, by a distance corresponding to the pitch P of the rings to position a traveler removing device 22 and a traveler attaching device 23 opposite to the traveler 7 positioned at the predetermined position as shown in FIG. 15. The traveler removing device 22 is advanced to set the traveler removing device 22 relative to the traveler 7 in a state as shown in FIG. 10*b*, and then the traveler removing device 22 is shifted along the ring rail to catch the traveler 7. A roller 18 (FIG. 15) is rotated in the reverse direction by a predetermined number of turns to slacken the yarn while the yarn drawing device 21 shown in FIG. 9 is actuated to draw the yarn to the ring 5. After removing the old traveler 7, a new traveler 7 is put on the flange 6 of the ring 5. Then, the roller 18 is rotated in the normal direction by a predetermined number of turns to thread the yarn through the new traveler 7. The tension device is not essential to this traveler changing apparatus; the traveler 7 can be positioned at the predetermined position by the rotation of the rollers 17 and 18 in the normal and reverse directions and the action of the stopper 25 to enable the traveler removing device 22 to remove the traveler 7. If the traveler changing apparatus is provided with the tension device, a sufficient length of the yarn is accumulated in the tension device and hence the rotation of the bobbin in the normal or reverse direction need not precisely be controlled. However, this traveler changing method requires a complicated procedure. Since the tension device maintains the yarn in an appropriate tension during the yarn drawing operation, the tension device ensures reliable yarn drawing operation. If the traveler changing apparatus is not provided with any tension device, it is possible that the yarn is broken when the bobbin is turned in the normal or reverse direction, if the turning of the bobbin is not controlled precisely on the basis of a signal provided by a tension sensor or the like. Accordingly, it is preferable to provide the traveler changing apparatus with a tension device.

The traveler changing apparatus in accordance with the present invention comprises the yarn drawing device, the traveler removing device, the traveler attaching device and the tension device for taking up the slack in the yarn and accumulating a length of the yarn to ensure the successful operation of the yarn drawing device. Accordingly, the bobbin need not be turned in drawing the yarn by the yarn drawing device because the yarn accumulated in the tension device is pulled out when the yarn is drawn by the yarn drawing device, and the yarn drawing device is able to draw the yarn smoothly.

Next, another embodiment of the traveler changing apparatus will be illustrated referring to FIGS. 17 to 20, in which different points of the traveller changing apparatus from that of the preceding embodiment are shown. A traveler changing apparatus of this embodiment comprises a traveler changing unit capable of traveling along a ring spinning frame, comprising a yarn holding means for holding a yarn passing a traveler, a spindle stopping means for stopping each spindle, a traveler moving means for moving a traveler on a ring by rotating a bobbin, and a yarn drawing device for drawing the yarn to the ring.

Traveler changing operation is carried out while the ring spinning frame is in operation by holding the yarn passing the traveler, stopping the spindle associated with the traveler, moving the traveler to a predetermined position, drawing portions of the yarn extending before and after the traveler and changing the old traveler for a new one.

The traveler changing operation of the traveler changing apparatus to a ring spinning frame SF and the travel of the same along the ring spinning frame SF will be described hereinafter. Referring to FIGS. 3*a*, 3*b* and FIG. 17, the links 53 are turned upward to hold the base 43 on the wheeled control unit 13. The traveler changing apparatus is transported by an operator along the floor to a ring spinning frame requiring a traveler changing operation. Then, the links 53 are turned downward so that the wheels 41 are in rolling contact with the front surface of the guide rail 10 and the wheels 42 are set in rolling contact with the upper surface of the guide rail 10. While the ring spinning frame is in operation, the ring rail 4 moves vertically through the stroke L at a very low speed in the range of 1 cm/sec to 2 cm/sec. The height of the first working unit 11*a* is adjusted so that the magnet wheels 50 are attracted to the front edge of the ring rail 4. Since the weight of the first working unit 11*a* is counter-balanced by the counter weight 49, the first working unit 11*a* can be easily moved in vertical directions for height adjustment and the ring rail 4 is not loaded excessively. It is preferable to determine the weight of the counterweight 49 so that the ring rail 4 is loaded slightly by the first working unit 11*a* because the ring rail 4, in general, is supported simply on poker rods and can be lifted up from the poker rods. The magnet wheels 50 of the first working unit 11*a* need only to be put on the front edge of the ring rail 4 to connect the traveler changing apparatus to the ring spinning frame and hence the traveler changing apparatus can be easily separated from the ring spinning frame. Since the traveler changing unit 11 is connected by the links 53 to the wheeled control unit 13 and is movable relative to the wheeled control unit 13, the first working unit 11*a* can be easily moved.

During the traveler changing operation, the magnet wheels 50 are driven by the motor 51 (FIGS. 3*a*, 3*b*) for controlled rotation to shift the traveler changing unit 11 by a distance corresponding to the pitch P of the rings 5 on the ring rail 4 at a time. The traveler changing unit 11 drags the wheeled control unit 13 through the plate spring 44, the base 43 and the links 53. Since the traveler changing unit 11 is supported on the plate spring 44 on the base 43, the traveler changing unit 11 can be moved slightly relative to the base 43 by a small force positioning the traveler changing unit 11 relative to the rings 5. The traveler changing unit 11, supported on the plate spring 44, can be quickly positioned by a positioning mechanism. The wheeled control unit 13 may be provided with a motor for driving the wheels 52 to move the wheeled control unit 13 when stress induced in the plate spring 44 and detected by a stress sensor 44*a*, attached to the plate spring 44, exceeds a predetermined limit.

The components of the first working unit 11*a*, the second working unit 11*b* and the third working unit 11*c* will be described hereinafter. Referring to FIGS. 17, 2*a* and 2*b*, the first working unit 11*a* has a positioning plate 16, a yarn drawing device 21, a traveler removing device 22, a traveler attaching device 23 and a waste traveler box 15. These components excluding the waste traveler box 15 are operated sequentially by a common driving source.

Referring to FIG. 17, the second working unit 11*b* is provided with a yarn holding device 17, and the third working unit 11*c* is provided with a roller 18 capable of being brought into contact with the lower portion of a bobbin 2, i.e., a traveler moving means for moving a traveler by rotating the bobbin, and an operating lever 119, i.e., a spindle stopping means, for operating a knee brake 101*a* to stop a spindle 1 so that a belt driving the spindle 1 slips relative to the spindle 1. Incidentally, some ring spinning frame is provided with spindles driven individually by individual motors, respectively. Such a spindle can be started or stopped by operating a start-stop switch, i.e., a spindle stopping means, disposed near the spindle. If the traveler changing apparatus is expected to be used for changing travelers on a ring spinning frame provided with such individually driven spindles, the third working unit 11*c* is provided with a switch operating rod for operating the start-stop switch. The lever 119 stops the spindle 1 to enable the traveler changing operation. The roller 18 rotates the bobbin 2 to move the traveler 7 on the ring 5 to position the traveler 7. The third working unit 11*c* may be provided with a braking device for stopping the spindle 1 or the bobbin 2.

Figure 18:
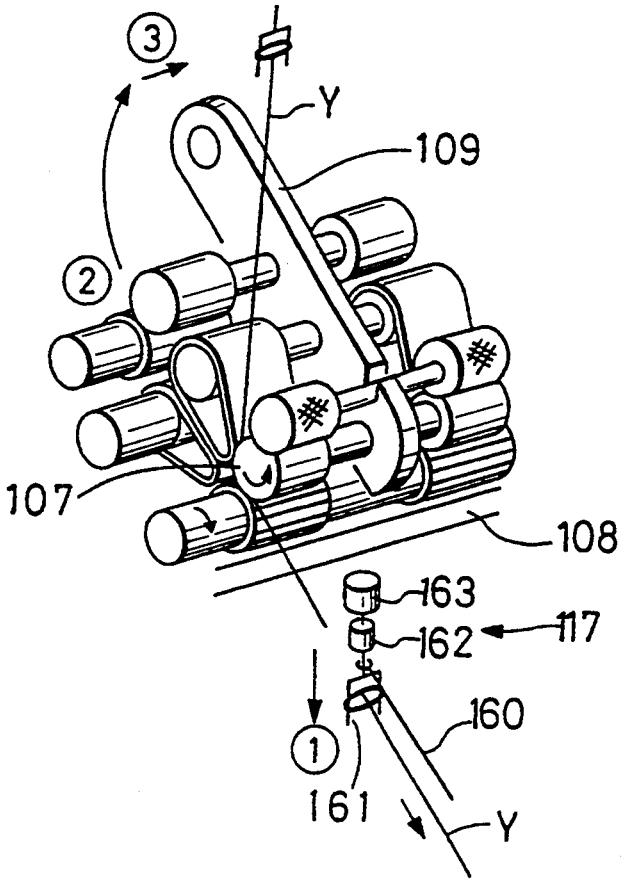
FIG. 18 is a perspective view of assistance in explaining the construction and functions of a yarn holding device.

The construction and functions of the yarn holding device 117 of the second working unit 11*b* will be described with reference to FIG. 18. A U-shaped catching member 161 is joined pivotally to the extremity of an arm 160. A motor 163 is connected operatively through a clutch 162 to the catching member 161. The arm 160 is advanced to a yarn passage and then moved laterally in the direction of the arrow ① to catch the yarn Y. Then, the clutch 162 is engaged to turn the catching member 161. Since the propagation of twists in a portion of the yarn extending before the catching member 161 is intercepted by the catching member 161, the yarn Y is broken at the catching member 161 and the yarn being delivered from the front roller of the ring spinning frame is sucked into a suction pipe 108. Since the bobbin 2 is rotating the yarn y extending after the catching member 161 is taken up by and accumulated on the catching member 161. When the clutch 162 is disengaged, the catching member 161 stops turning with a low torque acting thereon. As the ring rail, not shown, moves up and down, the yarn is taken up and released from the catching member 161. The length of the yarn accumulated on the catching member 161 corresponds to the length of the yarn to be pulled out when the yarn drawing device operates and the length of the yarn to be pulled out when the bobbin is rotated to move the traveler. The number of turns of the catching member 161, i.e., the number of turns of the output shaft of the motor 163, is controlled so that an appropriate length of the yarn is accumulated on the catching member 161. The yarn holding device 117 serves also as a yarn piecing device. Upon the completion of the traveler changing operation, the arm 160 is advanced in the direction of the arrow ② and moved laterally in the direction of the arrow ③. Then, the yarn Y pulled out from the catching member 161 is inserted between top and bottom front rollers 107 and pieced to the fleece being delivered by the top and bottom front roller 107. Since each drafting unit has a pair of top front roller 107 supported on a cradle arm 109 respectively on the opposite sides of the cradle arm 109, the arm 160 can be moved also in a direction opposite the direction of the arrow (3).

Figure 19A:
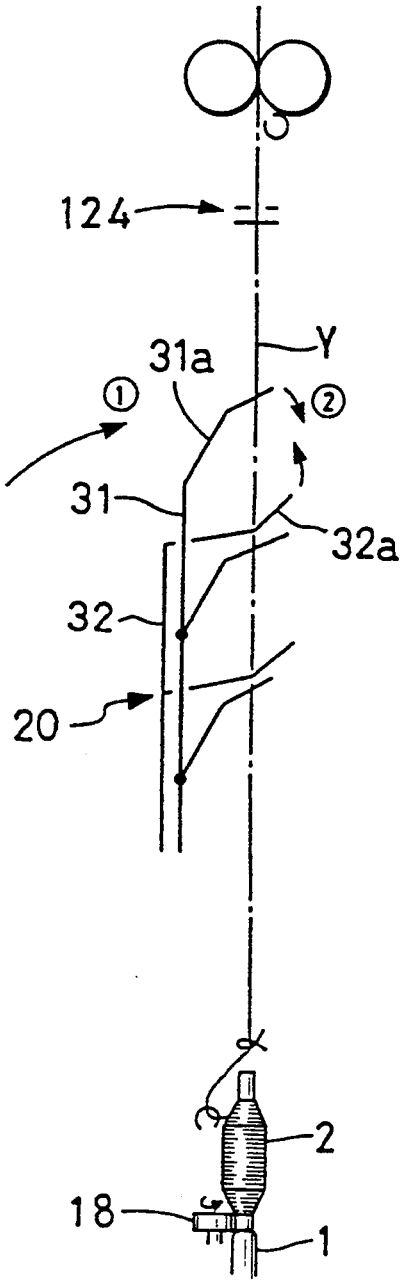
FIG. 19*a* shows an example of an embodiment of a yarn holding device in an inoperative state and FIG. 19*b* shows an example of an embodiment of a yarn holding device in an operating state.
Figure 19B:
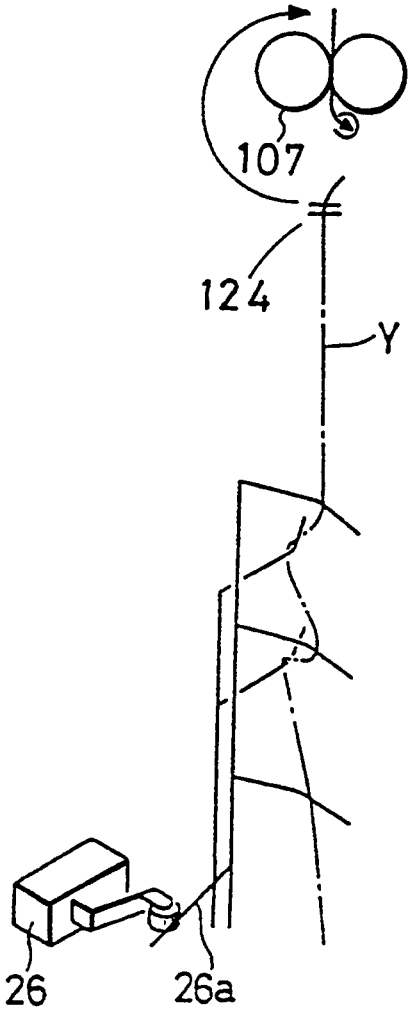
Figure 20:
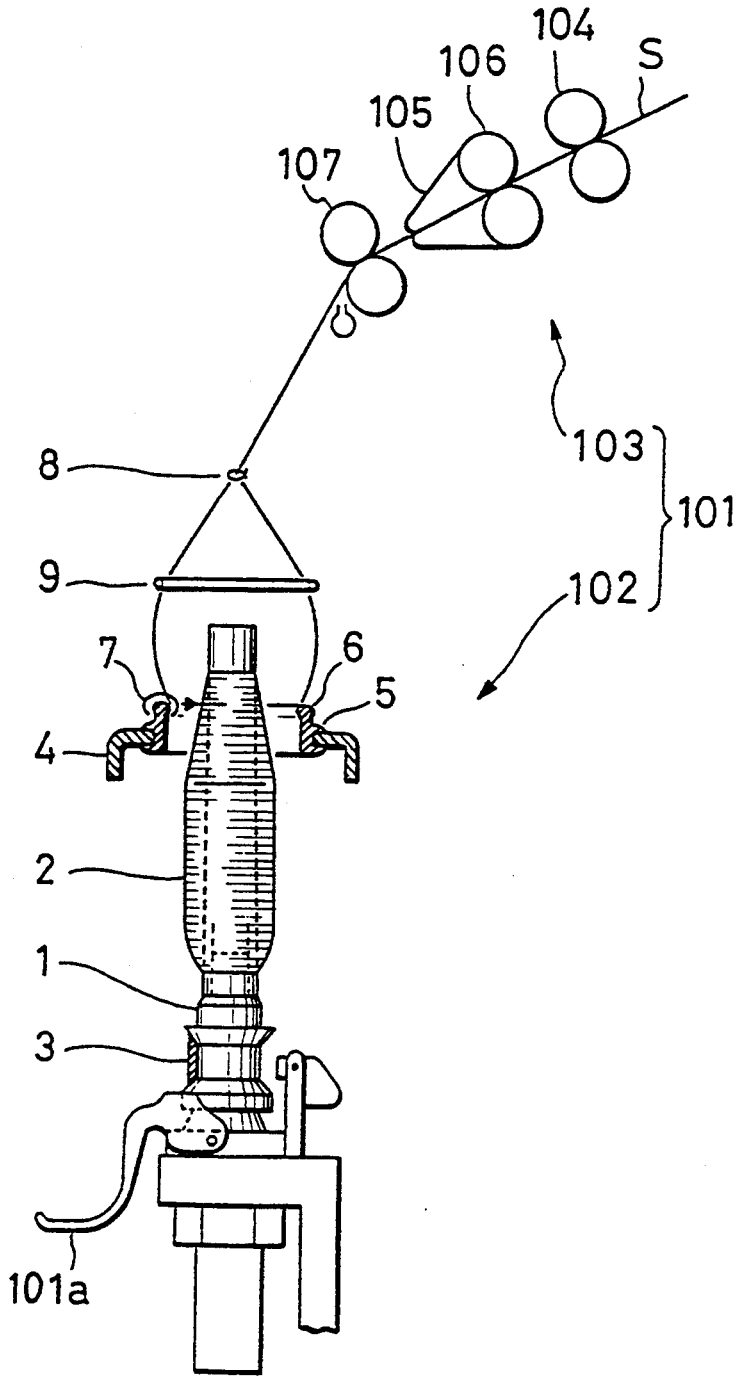
FIG. 20 is a side view of a ring spinning frame.

The yarn holding device 117 may be substituted by a yarn holding device as shown in FIGS. 19*a* and 19*b* consisting of a tension device 20 and a gripper 124. FIG. 19*a* shows the yarn holding device in an inoperative state and FIG. 19*b* shows the same in an operating state. As shown in FIG. 19*a*, the gripper 124 grips the yarn Y and, after the spindle 1 has been stopped, the roller rotates the bobbin 2 in the reverse direction to unwind the yarn y from the bobbin 2 and the slack thus produced in the yarn Y is taken up by the tension device 20. The tension device 20 comprises a pair of combs 31 and 32 disposed with their teeth in an alternate arrangement. The comb 31 has three teeth 31*a* and the comb 32 has two teeth 32*a*. When the teeth 31*a* and 32*a* are turned in opposite directions as indicated by the arrows (2) in FIG. 19*b*, the yarn Y extends zigzag between the teeth 31*a* and 32*a* so that the yarn Y is accumulated on the tension device 20. An actuator 26*a* attached to the lower end of the tension device 20 actuates a limit switch 26 when a sufficient length of the yarn Y is accumulated on the tension device 20. As shown in FIG. 19*b*, the gripper 124 is capable of taking the upper end of the yarn to a position behind the top and bottom front rollers 107.

A traveler changing procedure to be executed by the traveler changing apparatus will be described hereinafter. Referring to FIG. 17, the magnet wheels 50 of the first working unit 11*a* are rotated to position the traveler changing apparatus relative to the ring 5. Then, the positioning plate 16 is advanced so as to engage the ring 5 to position the traveler changing unit 11. Then, the yarn holding device 117 of the second working unit 11*b* is advanced to catch the yarn Y at a position between the snail wire 8 and the front rollers 107 with the catching member 161, and then the catching member is rotated to take up and hold a predetermined length of the yarn Y while the spindle 1 is rotating speed. Then, the lever 119 of the third working unit 11*c* is raised to apply the knee brake 101*a* to stop the spindle 1. The belt 3 slips relative to the braked spindle 1 and drives the rest of the spindles for rotation at a high rotating speed. As shown in FIG. 9*a*, the traveler removing rod 35 of the traveler removing device 22 is advanced to a predetermined position on the flange 6 and the roller 18 (FIG. 17) rotates the bobbin 2 by a predetermined number of turns in the normal direction to pull out the yarn Y from the yarn holding device 17 and to move the traveler 7 along the flange 6 of the ring 5 until the traveler 7 is caught by the hook 35*a* of the traveler removing rod 35 (FIG. 9*a*). Then, the roller 18 is retracted from the working position. Subsequently, the yarn drawing device 21 draws the yarn Y so as to extend a portion of the yarn Y obliquely across the flange 6 of the ring 5 as shown in FIG. 14*a*, further pulling out the yarn Y accumulated on the yarn holding device 17.

Then, as shown in FIG. 10*b*, the traveler removing rod 35 is turned in the direction of the arrow (6) to hold the traveler 7 between the hook 35*a* and the tip 40*a* of the holding plate 40, and then the traveler removing rod 35 is advanced in the direction of the arrow (7) (FIG. 10*c*) to remove the traveler 7 from the flange 6. When the traveler removing device 22 is retracted, the traveler 7 removed from the flange 6 is transported to a position above the waste traveler box 15 (FIG. 2*a*), the hook 35*a* is separated from the tip 40*a* of the holding plate 40 to drop the removed traveler 7 into the waste traveler box 15. Then, as shown in FIG. 11*a*, a new traveler 7 suspended from the traveler feed rod 36 is positioned at a predetermined position over the flange 6 of the ring 5, and then the traveler feed rod 36 is retracted in the direction of the arrow (9). Since one end of the new traveler 7 is in engagement with the flange 6, the new traveler 7 is expanded and the new traveler 7 is put on the flange 6.

After the new traveler 7 has been put on the flange 6 of the ring 5, the yarn drawing device 21 (FIG. 9*a*) is retracted from the working position, and then the yarn holding device 17 (FIG. 17) takes up the slack in the yarn Y again. Then, as shown in FIG. 18, the catching member 161 transports the yarn Y in a tight state to a position behind the front rollers 107 for yarn piecing. At the same time, the lever 119 releases the knee brake 101*a* so that the spindle 1 is able to rotate at the normal rotating speed. Thus, the traveler changing operation, which has been believed to be possible only by hand, can be achieved fully automatically, and the old travelers are collected in the waste traveler box 15. Therefore, the old travelers are not scattered around the ring spinning frame and hence the floor around the ring spinning frame need not be cleaned for scattered old travelers. Since the traveler changing operation is performed for individual spindles while the ring spinning frame is in operation, the operating efficiency of the ring spinning frame is not reduced.

Incidentally, although the traveler changing operation has been described as comprising sequential steps of moving the traveler to the predetermined position, drawing the yarn, removing the traveler from the flange of the ring and putting a new traveler on the flange of the ring to facilitate understanding the traveler changing operation, actually, these steps are executed simultaneously. The sequence of the steps may be changed if necessary; for example, the sequence of the traveler attaching step and the traveler removing step may be inverted.

The traveler changing apparatus of the present invention has the traveler changing unit capable of traveling along a ring spinning frame, and the traveler changing unit comprises the yarn holding means for holding the yarn extending from the bobbin through the traveler, the stopping means for stopping the spindle, the traveler moving means for rotating the bobbin to move the traveler, the yarn drawing device for drawing the yarn so that a portion of the yarn extend obliquely across the flange of the ring and the traveler changing means, and the traveler changing apparatus holds and accumulates the yarn, stops the spindle, moves the traveler to a predetermined position, draws the yarn so that a portion of the yarn extends obliquely across the flange of the ring, removes the old traveler from the flange of the ring and puts a new traveler on the flange of the ring. Thus, the traveler changing apparatus changes automatically the traveler on each ring at a time while the ring spinning frame is in operation without reducing the operating efficiency of the ring spinning frame.

What is claimed is:

1. An apparatus for changing a traveler on a ring of a ring spinning frame, comprising:

a carriage for traveling along the ring spinning frame and stopping at a location substantially adjacent the ring, a traveler changing unit supported on the carriage, the traveler changing unit comprising:

positioning means for positioning the traveler changing unit relative to the ring, yarn drawing means for drawing yarn toward the ring, traveler attaching means for attaching a traveler to the ring, and traveler removing means for removing a traveler from the ring, the traveler removing means comprising:

a tube that is advanceable toward the ring, a traveler removing rod that is supported within the tube and that is turnable relative to the tube, the traveler removing rod having a free end, a hook formed at the free end of the traveler removing rod, the hook being configured for engaging and removing a traveler from the ring, and a holding plate supported on the tube, the holding plate being configured to hold a traveler between the hook and the holding plate.

2. An apparatus for changing a traveler on a ring of a ring spinning frame, comprising:

yarn drawing means for drawing yarn toward the ring, tension means for taking up slack in the yarn, traveler removing means for removing a traveler from the ring, traveler attaching means for attaching a traveler to the ring, and yarn slack take off means for tightening the yarn when a ring spinning frame is restarted after a traveler is attached to the ring, the yarn slack take off means comprising:

a substantially L-shaped lever having a first arm, a second arm and a rotational axis, a brush attached to the first arm of the L-shaped lever and positioned to contact a traveler on the ring, a limit switch that is actuatable through contact with the second arm of the L-shaped lever, and spring means for biasing the second arm of the L-shaped lever away from the limit switch, whereby contact between the brush and the traveler causes the lever to rotate about the rotational axis, thereby bringing the second arm into contact with the limit switch.

3. An apparatus for changing a traveler on a ring of a ring spinning frame having a plurality of spindles, comprising:

a carriage for traveling along the ring spinning frame and stopping at a location substantially adjacent the ring, a traveler changing unit supported on the carriage, the traveler changing unit comprising:

yarn holding means for holding yarn passing through a traveler, spindle stopping means for stopping a spindle of the ring spinning frame, traveler moving means for moving the traveler by rotating a bobbin put on the spindle, yarn drawing means for drawing yarn toward the ring, traveler removing means for removing a traveler from the ring, and traveler attaching means for attaching a traveler to the ring, wherein the yarn holding means comprises a U-shaped catching member joined pivotally to the extremity of an arm, the catching member being connected to a motor operatively through a clutch so that an appropriate length of a yarn is accumulated on the catching member due to the turns of an output shaft of the motor.

* * * * *